United States Patent [19]

Rossi

[11] 4,252,010

[45] Feb. 24, 1981

[54] RECTILINEAR DRAWING MACHINE

[75] Inventor: Attilio Rossi, Legnano, Italy

[73] Assignee: Fachini & C. S.r.l., Milan, Italy

[21] Appl. No.: 958,031

[22] Filed: Nov. 6, 1978

[30] Foreign Application Priority Data

Nov. 16, 1977 [IT] Italy ..... 29727 A/77

[51] Int. Cl.[3] ..... B21C 1/12

[52] U.S. Cl. ..... 72/288; 72/289

[58] Field of Search ..... 72/279, 280, 288, 289

[56] References Cited

U.S. PATENT DOCUMENTS 3,750,449 8/1973 Rabe ..... 72/288

FOREIGN PATENT DOCUMENTS 154512 12/1953 Australia ..... 72/288

2111470 9/1972 Fed. Rep. of Germany ..... 72/289

*Primary Examiner*—Milton S. Mehr

*Attorney, Agent, or Firm*—Bucknam and Archer

[57] ABSTRACT

An improved rectilinear draw machine, effective to directly draw ferrous and non-ferrous materials, is described, which is capable of automatic and continuous control and capable of adjusting the working speed without conveying the drawn material onto outer sensors. The machine comprises drawing sections, each section being formed by a drawing ring, an idle ring coaxial therewith and a compensating arm between the rings. These three elements rotate in the same direction. The lower drawing ring is driven by the driving shaft. A hollow central shaft is fixed to the upper idle ring, which is coaxial with the lower drawing ring, but of lesser diameter. The lower end of the hollow shaft is connected to the central body of an electromagnetic brake. The compensating or balancing arm, located between the lower drawing ring and the upper idle ring, is rigid with a shaft the lower end of which is connected to the inner body of the electromagnetic coupling or coupling. The compensating or balancing arm is provided, at the periphery thereof, with a pulley capable of allowing for the working wire to slide and the consequent shifting of some turns thereof from the upper idle ring to the lower drawing ring and vice versa, as the upper ring is subjected to a deceleration or acceleration, so that the intermediate balancing assembly moves in the direction of the lower drawing ring or rotates in the opposite direction depending on the different working speeds.

13 Claims, 4 Drawing Figures

RECTILINEAR DRAWING MACHINE

The present invention relates to an improved rectilinear drawing machine, characterized in that it is provided with a new type of system for automatically continuously controlling and adjusting the working speed, without returning the drawn material onto outer sensors.

As it is known, the drawing process consists of introducing, by means of suitable tools and devices and successive passages, a ferrous or non-ferrous material wire from an originating or initial section as far as to a desired end section.

The drawing lines are normally formed by several like sections, provided with equal diameter drawing loops or rings onto which the wire to be drawn is wound.

In order to be able of carrying out a several-passage multiple drawing operation since, as it was described, the drawing machine comprises a plurality of sections, the linear speeds of the drawing or traction rings have to be different from one another due to the fact that the cross-section of the material is reduced at each passage, whereas the volume of the wire passing through each single section has to remain equal. In fact it is important to meet the following relationship: $V1.S1=V2.S2=V3.S3= \ldots =Vn.Sn$, where $V1,V2,V3 \ldots, Vn$ indicate the linear speeds of the several rings, and $S1,S2,S3 \ldots, Sn$ indicate the cross-sections of the material at the different passages.

Practically, this ideal working condition is particularly difficult to be met or maintained during the working operations: accordingly any variation of speed "V" or cross-section "S" inevitably involves deleterious variations in the drawing or traction onto the wire being handled.

To eliminate this drawback, several drawing machines have been made which, however, are not able of providing satisfactory results.

The present invention particularly relates to a new type of multiple-section drawing machine, suitable for the drawing of ferrous and non-ferrous materials by means of the direct draw system, with an automatic and continuous control and adjustment of the working speed without using sensors or outer transmissions to the drawing ring, without producing any bending onto the wire in addition to that formed during the normal winding up onto the drawing ring, and without any manual handling by an operator.

These and other characteristics of functional and constructional nature of the improved rectilinear drawing machine according to the present invention will become more apparent from the several figures of the accompanying drawings, in which.

Figure 1:
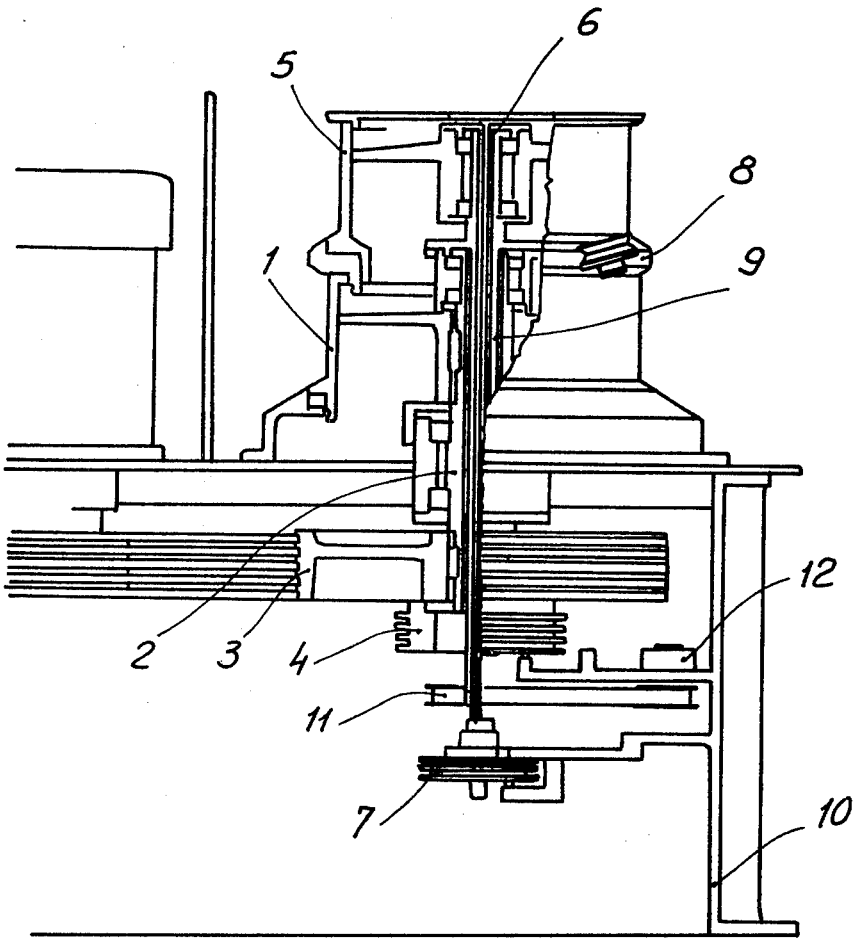
FIG. 1 illustrates a schematic diagramm of this new type of drawing machine, by means of a longitudinal and partially cross-sectioned view.

Referring specifically to the aforesaid figures, FIG. 1 illustrates the several elements constituting a machine section, and the specific mutual association of said elements.

The lower drawing or traction ring (1) is made rigid with the driving shaft (2) to which is keyed the pulley or driving reducing gear (3).

The driving shaft (2) is extended and at one end is connected the outer body of an electromagnetic coupling or clutch (4).

To the upper idle ring (5), coaxially with respect to the lower ring (1) but of lesser diameter, is mechanically fixed the hollow central shaft (6) at one end of which is connected the central body of an electromagnetic brake (7).

The compensating or balancing arm (8), located between the two rings (1) and (5), has the function of shifting the wire they are wound up onto the two rings (1) and (5), from one another, depending on the different working speeds of said rings.

The shaft (9) rigid with said balancing arm (8) is connected to the inner body of the electromagnetic coupling (4).

The three hereinabove described elements, i.e. the drawing ring (1), the idle ring (5) coaxial therewith and the compensating or balancing arm (8) located therebetween, comprise a drawing machine section.

Figure 2:
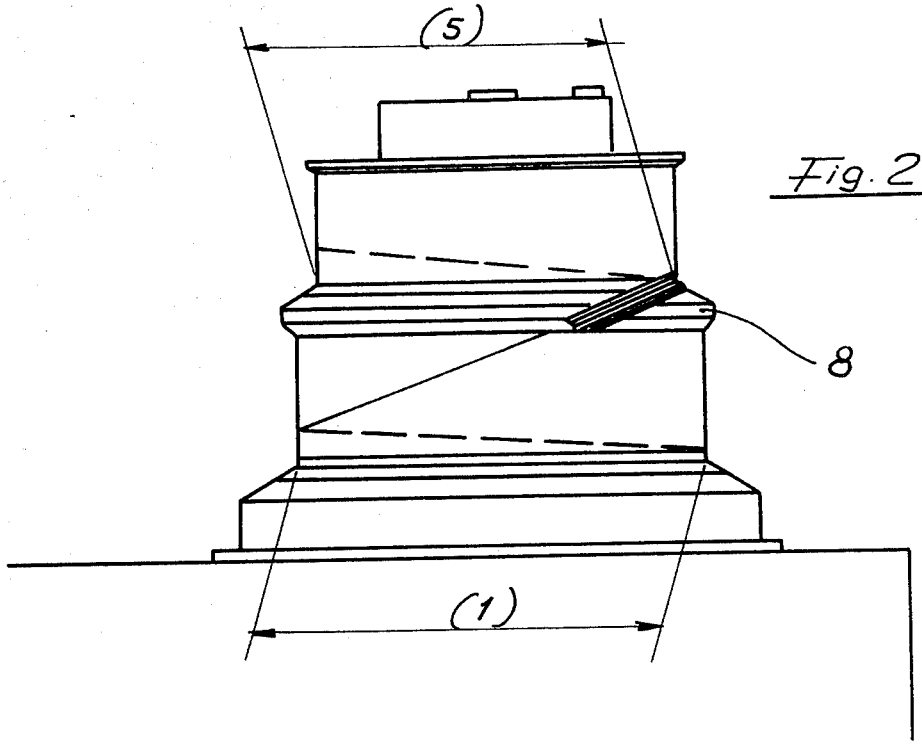
FIG. 2 is a detail view of the drawing machine portion comprising the drawing ring, the idle ring coaxial therewith and the compensating arm: the cited three elements comprising a drawing section.
Figure 3:
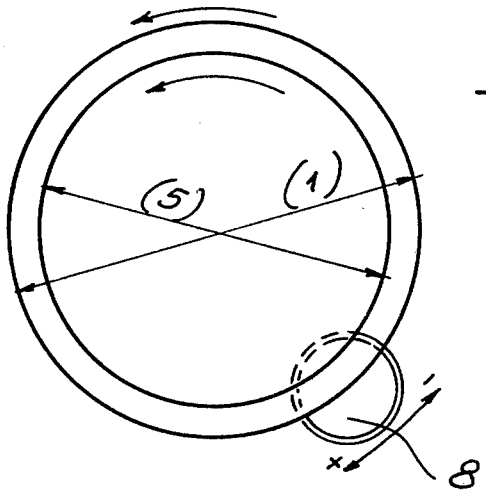
FIG. 3 is a schematical axial view illustrating how the wire is wound up always in the same direction onto the three elements illustrated in FIG. 2.

Referring to FIGS. 2 and 3, it should be noted that the lower drawing ring (1) and upper idle ring (5) rotate in the same direction. In fact the ring (1) is driven by the driving shaft (2), whereas the idle ring (5) is rotated by the wire itself as taken up by the subsequent drawing bobbin.

From the above it should be clear that the wire is wound up always in the same direction both onto the lower ring (1) and the upper ring (5), passing onto the pulley of the balancing arm (8).

As thereinabove described, the three aforesaid elements are not however completely able to rotate, one with respect to the other two, being tied or connected as follows: (1) and (8) through the electromagnetic coupling (4), and the central shaft (6) with the electromagnetic brake (7) fixed to the carter (10).

The electromagnetic coupling (4) and electromagnetic brake (7) are located outwardly from the drawing rings, so that the heat developed during the action thereof is prevented from being completely transmitted to the wire being worked.

The braking couples trying or connecting the three elements (1), (8) and (5) may be adjusted at will by means of a drive or control, not necessarily of the manual type, and they may be predetermined in the rest condition of the machine, or adjusted even in the operating condition of the machine. As it was thereinabove described, the electromagnetic coupling or clutch assembly (4) provides a driving action between the two elements (1) and (8).

Considering the operation of two drawing heads and assuming that for two adjacent drawing heads the speeds and sections thereof are those theoretical meeting the relationship: $V1.S1=V2.S2$ and due to the fact that the wire section does not change passing from (1) to (5), it follows that the revolution number of (5) will be equal to: $n2=\phi(1)/\phi(5).n1$ (where: $n1$=r.p.m.'s of the lower ring and $\phi$ is the diameter of the ring).

Under this conditions it will follow that: $\phi(1)$ will rotate with a revolution number of: n1 $\phi(5)$ will rotate at a revolution number of: $n2=\phi(1)/\phi(5)$. n1

The intermediate element (8) which, as connected to the electromagnetic coupling or clutch (4), would tend to rotate in the same direction of the two rings, is however held stationary by the wire passing on the pulley, because through the lower ring passes the same wire volume passing through the upper ring; therefore is not necessary for the pulley (8) to compensate the speed errors of the two rings (1) and (5).

If the thereinabove described balancing condition is subjected to alterations or, more precisely if the speed and hence the r.p.m.'s "n2" of the upper ring (5) is reduced or increased, then the intermediate balancing assembly or pulley (8) will move in the direction of the drawing lower ring, as driven by the electromagnetic coupling (4), if (5) slows down, and in this case the turns will be shifted by the ring (5) onto the ring (1); the balancing assembly (8) will rotate in the opposed direction of (1) as pushed by said wire, if the ring (5) accelerates and the turns will move from (1) onto (5).

The balancing arm (8), by means of the transmission element (11), will rotate a control assembly (12), which may be formed by a rheostat, a potentiometer, a flow valve or any other element effective to modify the r.p.m.'s of the driving motor.

It should be apparent that, if the r.p.m.'s of the ring (5) increase, to reestablish the equilibrium, (1) will have to increase its r.p.m.'s and then the motor will receive a positive signal whereas, if (5) reduces its r.p.m.'s, then also (1) will have to reduce its r.p.m.'s due to the same reason. The correction of the revolution number onto the motor, as introduced by the element (12), will persist as far as the equilibrium will again be reached, (8) being stationary.

The eventual delay which may be present between the variation of the r.p.m.'s of (5) and the consequent variation of the r.p.m.'s of (1) will be compensated for by the intermediate assembly (8) which will tend to shift the turns from (1) to (5), if (5) accelerates, whereas it will shift said turns from (5) to (1), if (5) slows down, thereby preventing the turns from loosening.

In this type of operation, it is possible to have the diameters "$\phi(1)$ and "$\phi(5)$ very similar to one another, since the correction of the speed of (1), as introduced by the control assembly (12), is relatively quick, and the arm (8) will therefore move through a small angular range.

By exploiting the aforesaid concept, and precisely the comparison of the rotation speed of the two rings (1) and (5), in order to obtain the automatic control of the working speeds, it is possible to provide drawing machines having the operation characteristics of the typical drawing machine illustrated in FIG. 2 and thereinabove described.

Figure 4:
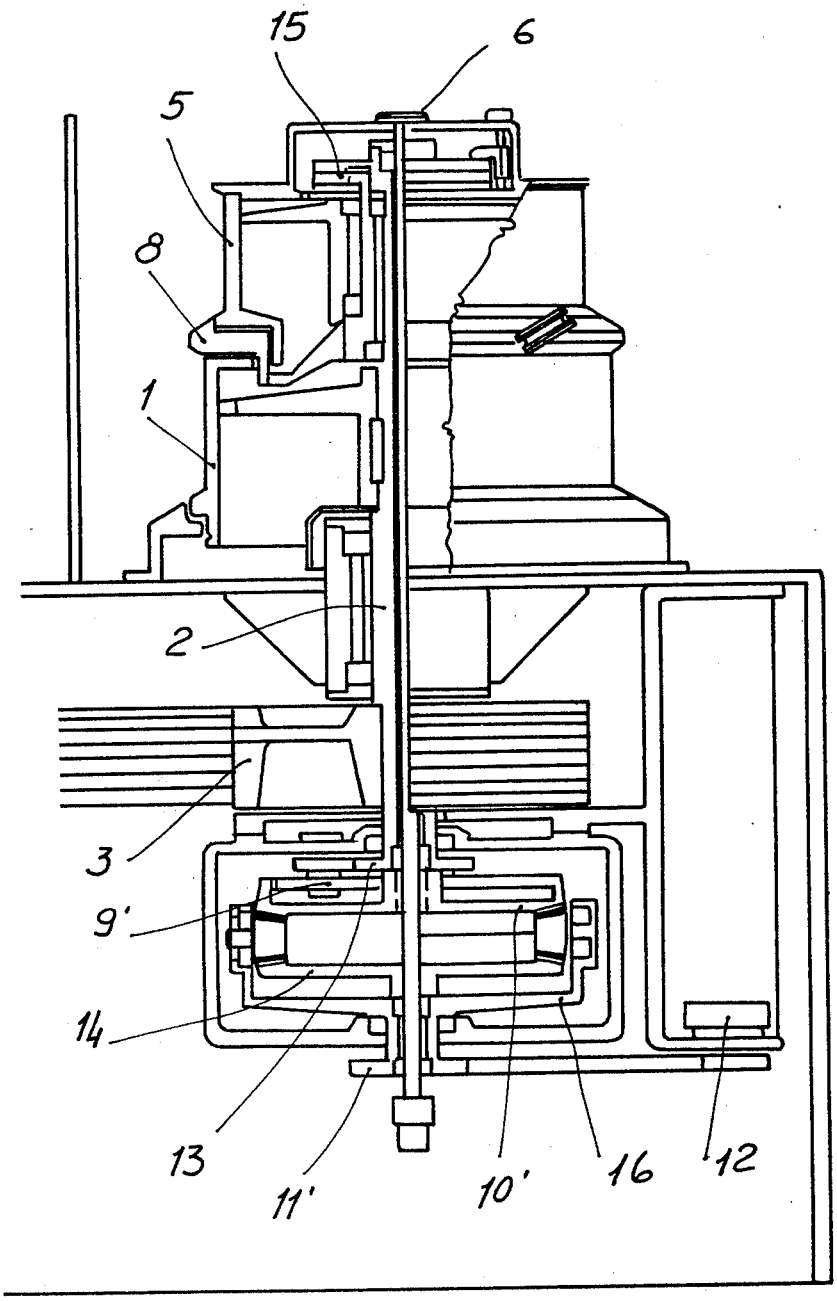
FIG. 4 is a side and partially sectioned view illustrating a preferred exemplificative embodiment of the improved rectilinear drawing machine according to the present invention.

In particular a preferred exemplificative embodiment of the improved drawing machine according to the present invention is illustrated in FIG. 4 showing the schematic diagram of the machine and all the elements comprising a machine section.

In fact there is shown the lower drawing ring (1) rigid with the driving shaft (2) to which is keyed the pulley or driving reducing gear (3).

The driving shaft (2) is extended and terminates with a gear wheel (13).

To the upper idle ring (5), coaxial with the lower ring (1) but of lesser diameter, is mechanically fixed the central shaft (6) which terminates with a bevel gear wheel (14).

The balancing arm (8), located between the two rings (1) and (5) acts to shift the wire turns which are wound onto the two rings (1) and (5), from one to the other, depending on the different working speeds thereof.

The three aforesaid elements, i.e. the drawing ring (1), the idle upper ring (5) and the balancing arm (8) form a drawing section. The lower drawing ring (1) and the idle upper ring (5) rotate in the same direction, as it is shown in FIGS. 2 and 3.

In fact the ring (1) is driven by the driving shaft (2), whereas the idle ring (5) is rotated by the wire itself as taken up by the next drawing bobbin. From the above discussion, it should be apparent that the wire is wound always in the same direction, both onto the lower ring (1) and the upper ring (5), passing onto the pulley of the balancing arm (8).

The aforesaid three elements are not however completely free of rotation, one with respect to the other two, but they are connected to one another by a clutch assembly (15).

This assembly is completely cooled by a water forced circulation, thereby eliminating all the heat due to the friction, without transmitting the heat to the ring (5) and then to the wire.

The braking couple tying the three elements (1), (5) and (8) may be adjusted at will by means of a drive, not necessarily of manual type, which may be adjusted both in the idle and in the operative condition of the machine.

As it has been described hereinabove the clutch assembly (15) provides a braking action between the three aforesaid elements.

If we consider the operation of two drawing heads and under the condition that for two adjacent heads the speeds and sections thereof are those theoretical and meet the relationship $V1.S1=V2.S2$, and since for construction is: $\phi(1)\neq\phi(5)$ and for description simplicity assume: $\phi(1)>\phi(5)$, since the wire section does not change from (1) to (5), then the revolution number of (5) will be:

$$n2=\phi(1)/\phi(5).n1$$

(where: n1=r.p.m.'s of the lower ring)

Under these conditions we have that: $\phi(1)$ will rotate with a revolution number: n1 $\phi(5)$ will rotate with a revolution number: $n2=\phi(1)/\phi(5).n1$ The intermediate element (8) which, due to the clutch assembly (15), would rotate in the same direction of the two rings, is however held stationary in its position by the wire passing onto the pulley, since onto the lower ring passes the same volume of wire passing onto the upper one; therefore it is not necessary for the pulley (8) to compensate the speed errors of the two rings (1) and (5).

Considering now the epicycloidal system tying the upper ring (5) to the lower ring (1) through the transmission gear (9'). This transmission gear is designed in such a way that the ratio thereof is: $\phi(1)/\phi(5)$.

Under this condition, as the upper ring (5) rotates at $n2=\phi(1)/\phi(5).n1$ and the lower ring (1) rotates at n1, the two sun wheels (14) and (10') will rotate at the same revolution number, but in the opposed direction or with opposed sign, due to the transmission gear (9') and the intermediate planetary element carrying member (16), owing to the known propertied of the epicycloidal assemblies, will be stationary. In fact, if n3 represents the revolution number of the planetary element carrying train, we have:

$$n3=n1-n2/2.$$

But if: $n1=-n2$, i.e. of opposed sign, we have:

$$n3=0.$$

If the above considered equilibrium condition should be modified or, more specifically, if the upper ring (5) should increase or reduce the speed and then the revolution number "n2", also due to the law of the epicycloidal assemblies with two transmitting elements (10') and (14) and a receiving element (16), the equilibirum condition will be modified, and the planetary element carrying member (16) will rotate in the direction of the sun wheel provided with the greater peripheral speed.

The planetary element or gear carrying member (16), through the transmission (11'), will rotatively drive a control assembly (12') which may be formed by a rheostat, a potentiometer, a flow valve or any other element suitable for modifying the revolution number of the driving motor.

It should be apparent that if the ring (5) increases the revolutions, in order to restablish the equilibrium, also (1) has to increase the revolutions, and therefore the motor will receive a positive signal, whereas if (5) reduces the revolutions also (1) has to reduce its revolutions owing to that same reason. The correction of the revolution number onto the motor, as introduced by the element (12') will persist as far as the equilibrium is again reached with (16) stationary.

The eventual delay which may be present between the variation of the revolutions of (5) and the consequent variation of the revolution of (1) will be compensated by the intermediate assembly (8), which will tend to shift the turns from (1) onto (5), if (5) accelerates, whereas it will shift the turns from (5) onto (1), if (5) decelerates.

With this type of operation, it is possible to have the diameter "$\phi$(1)" and "$\phi$(5)", very similar to one another, since the correction of the speed of (1), as introduced by the control assembly (12'), is comparatively rapid, and the arm (8) accordingly will move only for a small angular range.

I claim:

1. A machine for drawing wire through a series of drawing operations and for winding the wire, which comprises a first drawing drum mounted for rotation, a second idle drum mounted for rotation coaxial with said drum and a guide element journaled between said first and second drum, said first and second drum rotating in the same direction, said second drum having diameter smaller than said first drum, a driving shaft for actuating said first drum, a central shaft, said second drum being fixed to said central shaft, said guide element being held stationary during operation and being capable of shifting the wound up wires from the first drum to the second drum and viceversa in response to differences in rotational speed between said first and second drum, braking means connected to the lower end of said central shaft.

2. The machine according to claim 1 which comprises a frame, clutching means connecting said first drawing drum to said guide element, said braking means connected to the lower end of said central shaft connecting said second drum to the frame.

3. A machine according to claim 1, wherein said guide element is provided, at the periphery thereof, with a pulley, and during abnormal operation the wire slides and shifting of some turns of the wire from the second idle drum to the first drawing drum and viceversa is carried out by said pulley when the second drum is subjected to an erroneous deceleration and acceleration and said guide element and pulley form a balancing assembly which moves in the direction of the first drawing drum when the speed of the second drum is reduced and the wound-up wire is shifted onto the first drum or rotates in the opposite direction when the speed of the second drum increases and the wound-up wire is shifted onto the second drum and wherein during the normal drawing operation, the same wire volume passes onto the first and second drum and the guide element remains stationary, held by the wire passing onto the pulley of said balancing assembly.

4. A machine according to claim 3, which is provided with a motor, a control assembly for the control of the revolutions of the motor, and a transmission gear rigid with said central shaft onto which the guide element is fixed is provided, and rotations of the guide element are transmitted to said control assembly.

5. A machine, according to claim 4 which comprises a driving reducing gear keyed onto said driving shaft connected to said first drum and a gear wheel is provided at the lower end of said driving shaft.

6. A machine according to claim 5, wherein said central shaft to which the second drum is fixed, ends with a bevel gear wheel.

7. A machine according to claim 6 wherein a clutch assembly connects the first drum, the second drum and the guide element and said clutch assembly is cooled by water and the braking couple of said clutch assembly is adjustable, both in the stationary and in the operating condition of said machine.

8. A machine according to claim 3 which comprises a transmission element connecting said second drum and said first drum and said transmission element comprises an epicycloidal system comprising an upper sun wheel and a lower sun wheel, and a planetary element carrying member inserted therebetween.

9. A machine according to claim 8, wherein the lower sun wheel of the epicycloidal system is formed by a bevel gear wheel rigid with the lower end of said central shaft, and the upper sun wheel of the epicycloidal system is rotatively applied onto said central shaft to which is fixed the lower sun wheel.

10. A machine according to claim 9, wherein the transmission element comprises two rigid and coaxial gear wheels, the driving shaft has a gear wheel rigid thereto, the first gear wheel meshes with said gear wheel rigid with the driving shaft, the second gear wheel engages with a perimetrical toothed surface located in the interior of the upper cavity of the upper sun wheel, and said upper sun wheel is rotated in a direction opposite to said gear wheel.

11. A machine according to claim 10, which comprises a cylindrical supporting member, a planetary element carrying member completing the epicycloidal system which is provided with two planetary gear carrying arms, connected at the lower portion thereof onto said cylindrical supporting member which is rotatably applied onto said shaft to which is fixed the lower sun wheel.

12. A machine according to claim 11, wherein during the drawing operation and under equilibrium conditions, as the speed of the second idle drum and the first drum are the proper ones, the two sun wheels rotate with the same number of revolutions, but in an opposite direction, and the planetary gear carrying member remains stationary.

13. A machine according to claim 12 wherein, during the drawing operation, the second idle drum rotated by the wire, in turn pulled by the first drawing drum, changes its speed, the planetary gear carrying member rotates in the direction of the sun wheel having the greater speed and, acts onto said control assembly.

* * * * *